United States Patent [19]

Conti

[11] Patent Number: 4,913,170

[45] Date of Patent: Apr. 3, 1990

[54] AXIAL CIGARETTE DISPLACING DEVICE

[75] Inventor: Igino Conti, Bologna, Italy

[73] Assignee: G.D Societa Per Azioni, Turin, Italy

[21] Appl. No.: 198,003

[22] Filed: May 24, 1988

[30] Foreign Application Priority Data

May 28, 1987 [IT] Italy ..... 3493 A/87

[51] Int. Cl.[4] ..... A24C 5/32

[52] U.S. Cl. ..... 131/282; 131/94; 198/458; 198/951

[58] Field of Search ..... 131/94, 282; 198/458, 198/951, 471.1, 474.1, 476.1, 477.1

[56] References Cited

U.S. PATENT DOCUMENTS

| | | | |
|---|---|---|---|
| 3,215,250 | 11/1965 | Schubert | 198/951 X |
| 3,319,764 | 5/1967 | Gamberini | 198/951 X |
| 3,372,702 | 3/1968 | Bohn et al. | 131/94 |
| 3,625,103 | 12/1971 | Giatti | 131/94 |
| 4,211,318 | 7/1980 | Verjux | 198/951 X |
| 4,519,405 | 5/1985 | Seragnoli | 131/94 |
| 4,556,072 | 12/1985 | Horie et al. | 198/951 X |
| 4,605,015 | 8/1986 | Grieben | 131/94 |
| 4,664,249 | 5/1987 | Gherardi | 131/282 X |
| 4,676,360 | 6/1987 | Mattei et al. | 198/458 X |
| 4,746,006 | 5/1988 | Nixon et al. | 198/458 |

*Primary Examiner*—Vincent Millin
*Assistant Examiner*—Joe H. Cheng
*Attorney, Agent, or Firm*—Marshall, O'Toole, Gerstein, Murray & Bicknell

[57] ABSTRACT

A device for axially displacing cigarettes arranged side by side in two substantially parallel rows traveling routes substantially perpendicularly in relation to the cigarette axes; which device includes an input roller and an output roller arranged parallel with each other and designed to feed the cigarettes along routes which are separated by a given distance in a direction parallel with the axes of the cigarettes and, for at least one of the aformentioned rows, comprises a roller mounted for rotation about an axis inclined in relation to the axes of the input and output rollers; at least one of the rollers being an adapted roller having seats for cigarettes, each of whose seats is formed on a support designed to swing in a radial plane of the adapter roller and about an axis perpendicular to the axis of rotation of the adapter roller.

8 Claims, 3 Drawing Sheets

AXIAL CIGARETTE DISPLACING DEVICE

BACKGROUND OF THE INVENTION

The present invention relates to a device for axially displacing cigarettes.

In particular, the present invention relates to a device designed to axially displace cigarettes arranged side by side in two substantially parallel rows traveling on a conveyor perpendicular relative to the cigarette axes.

The present invention may be used to adjust the distance between two rows of cigarettes, e.g. for inserting a double filter between two coaxial cigarettes in the said rows. It was previously known that axial displacement of cigarettes in two parallel rows could be achieved using, for each said row, an input and an output conveying member separated transversely by a given distance with both members designed to feed the cigarettes to the respective row perpendicular relative to the cigarette axes; and with a spacer device located between the two conveyors.

The said spacer device usually comprises a pair of opposed taper rollers tangent to each other and respectively tangent, along a generating line, to the said input and output conveying members.

Though of fairly straightforward design, the above solution usually involves four taper rollers, each with respective suction seats, which, in addition to being relatively cumbersome, are also complicated to manufacture.

SUMMARY OF THE INVENTION

The aim of the present invention is to provide a device for separating pairs of cigarettes arranged in two parallel rows, which is both compact and of straightforward mechanical design.

With this aim in view, according to the present invention, there is provided a device for axially displacing cigarettes arranged side by side in two substantially parallel rows traveling in a direction substantially perpendicular to the axes of the said cigarettes; said device comprising an input roller and an output roller arranged parallel with each other and designed to feed the said cigarettes in the said direction of travel along routes which, for at least a first of the said rows, are separated by a given distance parallel with the axes of the said cigarettes; and means for transferring the said cigarettes in both said rows from the said input roller to the said output roller; characterised by the fact that, for at least the said first row, the said transfer means comprise a transfer roller mounted for rotation about an axis inclined in relation to the axes of the input and output rollers; each said roller presenting peripheral seats for said cigarettes, and at least one of the three rollers being an adapter roller comprising, for each of the respective said seats for accommodating cigarettes in the said first row, a swing support mounted for swinging in a radial plane of the said adapter roller and about an axis perpendicular to the axis of rotation of the transfer roller.

BRIEF DESCRIPTION OF THE DRAWINGS

A number of non-limiting embodiments of the present invention will be described by way of examples with reference to the accompanying drawings, in which.

DETAILED DESCRIPTION OF THE INVENTION

Figure 1:
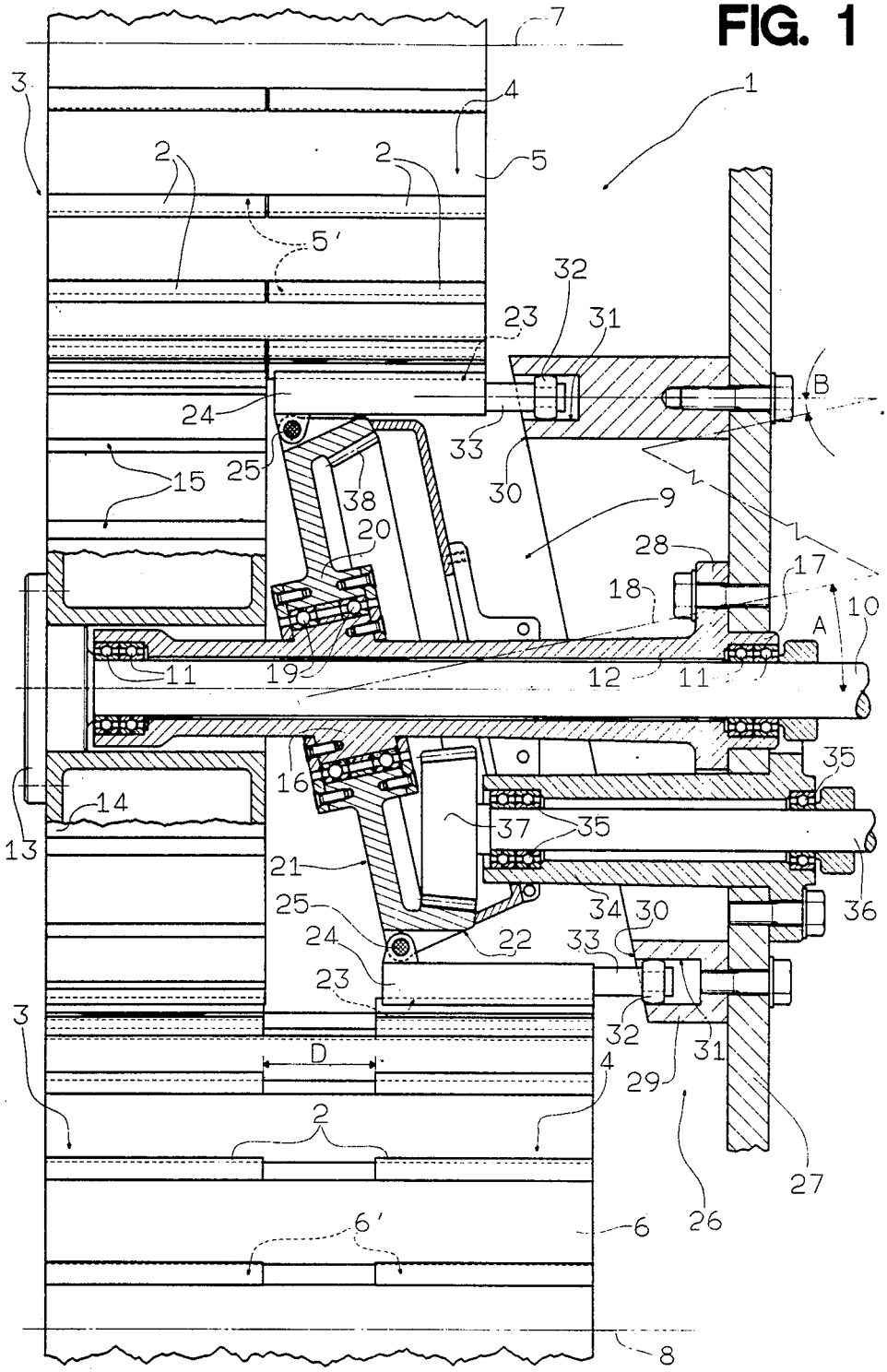
FIG. 1 shows a schematic section of a first embodiment of the axial displacing device according to the present invention.

Number 1 in FIG. 1 indicates a device for axially displacing cigarettes 2 arranged side by side in two substantially parallel rows 3 and 4 traveling substantially perpendicular in relation to the axes of cigarettes 2. Device 1 comprises an input roller 5 and an output roller 6 parallel with each other and designed to turn about respective parallel axes 7 and 8, by virtue of actuating means (not shown), so as to feed cigarettes 2 in the said direction along routes which, at least for row 4, are separated, in the example shown, by a given distance D parallel with the axes of cigarettes 2. The said rollers 5 and 6 present respective equally-spaced seats 5' and 6' arranged in two parallel rows and each designed to house a cigarette 2 in row 3 and 4 respectively.

Device 1 also comprises a transfer device indicated as a whole by 9 and designed to transfer cigarettes 2 in both rows 3 and 4 from input roller 5 to output roller 6. Device 9 comprises a supporting shaft 10 parallel with axes 7 and 8 and turned about its own axis by drive means (not shown). Shaft 10 is fitted in rotary manner, via the interposition of bearings 11, with a stationary coupling 12, from one end of which projects one end of shaft 10 having a flange 13 connected to a cylindrical roller 14 located between and tangent to rollers 5 and 6. Roller 14 presents peripheral seats 15 designed to receive and retain cigarettes 2 from row 3 fed forward by roller 5 and transfer the same, with no axial displacement, on to roller 6.

Coupling 12 is provided externally with two cylindrical hubs 16 and 17, hub 16 being located halfway along coupling 12, and hub 17 on the end of stationary coupling 12 opposite the end facing flange 13.

Hub 16 presents an axis 18 inclined by angle A in relation to the axis of shaft 10, and supports in rotary manner, via the interposition of bearings 19, the inner hub 20 of a tapered transfer roller 21, hereinafter referred to also as an "adapter roller", having a truncated-cone outer surface 22, the generating lines of which form, together with axis 18, an angle B equal to angle A. Adapter roller 21 presents a number of equally-spaced peripheral seats 23, each formed on a respective swing support 24 located outwards of surface 22.

Each swing support 24 pivots an adapter roller 21 via a respective pin 25 carried by roller 21 close to the longer side of surface 22 and substantially tangent to the same. By virtue of an actuating device indicated as a whole by 26, each support 24 is designed to turn about the axis of respective pin 25, and in a radial plane of adapter roller 21, between a withdrawal position wherein support 24 contacts surface 22, and an extracted position wherein support 24 is turned outwards in relation to surface 22 by an angle equal to twice angle A. Each support 24 swings between the said withdrawal and extracted positions as adapter roller 21 turns 180° about axis 18, during which rotation, support 24 moves together with roller 21 from a position wherein it is tangent to the outer periphery of roller 5, into a position wherein it is tangent to the outer periphery of roller 6, in such a manner as to feed on to roller 6 a respective cigarette 2 fed by roller 5 along row 4, and to axially separate the same from the respective cigarette 2 in row 3 by a distance D substantially equal to:

$D=2R \sin A$ wherein R is the radius of the longer side of surface 22. Device 26 comprises a stationary plate 27 perpendicular to the axis of shaft 10 and connected integral with flange 28 on hub 17; which stationary plate 27 is fitted with a toroidal body 29 defined, on the side facing adapter roller 21, by a surface 30 perpendicular to axis 18 and having a front annular groove 31 defining a cam engaged by a number of tappet rollers 32, each supported in rotary manner by a rod 33 extending axially from one end of respective support 24 opposite the end connected to respective pin 25. Groove 31, which together with the said tappet rollers 32 and respective rods 33 forms part of actuating means for swinging supports 24, is formed so as to position each support 24 in the said withdrawal and extracted positions as it travels past rollers 5 and 6 respectively.

Plate 27 is fitted through with a coupling 34 integral with plate 27 and supporting, via the interposition of bearings 35, a powered shaft 36 parallel with shaft 10 and designed to drive adapter roller 21. For this purpose, the end of shaft 36 facing roller 21 is fitted with a bevel gear 37 meshing with internal bevel teeth 38 on roller 21.

In actual use, a known suction device (not shown) connected to supports 24 provides for transferring cigarettes 2 in row 4 from roller 5 to roller 6, while at the same time axially displacing the same by distance D.

In the FIG. 2 embodiment, this is achieved by means of a transfer device 39 similar to device 9 and on which hub 16 supports in rotary manner a transfer roller 40, hereinafter also referred to as an adapter roller, mounted for rotation about axis 18 and defined externally by a cylindrical surface 41 coaxial with axis 18. Each of swing supports 24 is connected to surface 41 by a respective intermediate pin 42 about which each support 24 is designed to swing, in relation to adapter roller 40 and by virtue of actuating means comprising a cam actuating device 43 similar to device 26, between a first position wherein support 24 is parallel with axis 7, and a second position wherein it is parallel with axis 8. Each support 24 swings between the said two parallel positions by virtue of the angle of axis 18 in relation to axes 7 and 8, and swings through an angle equal to twice angle A.

Figure 3:
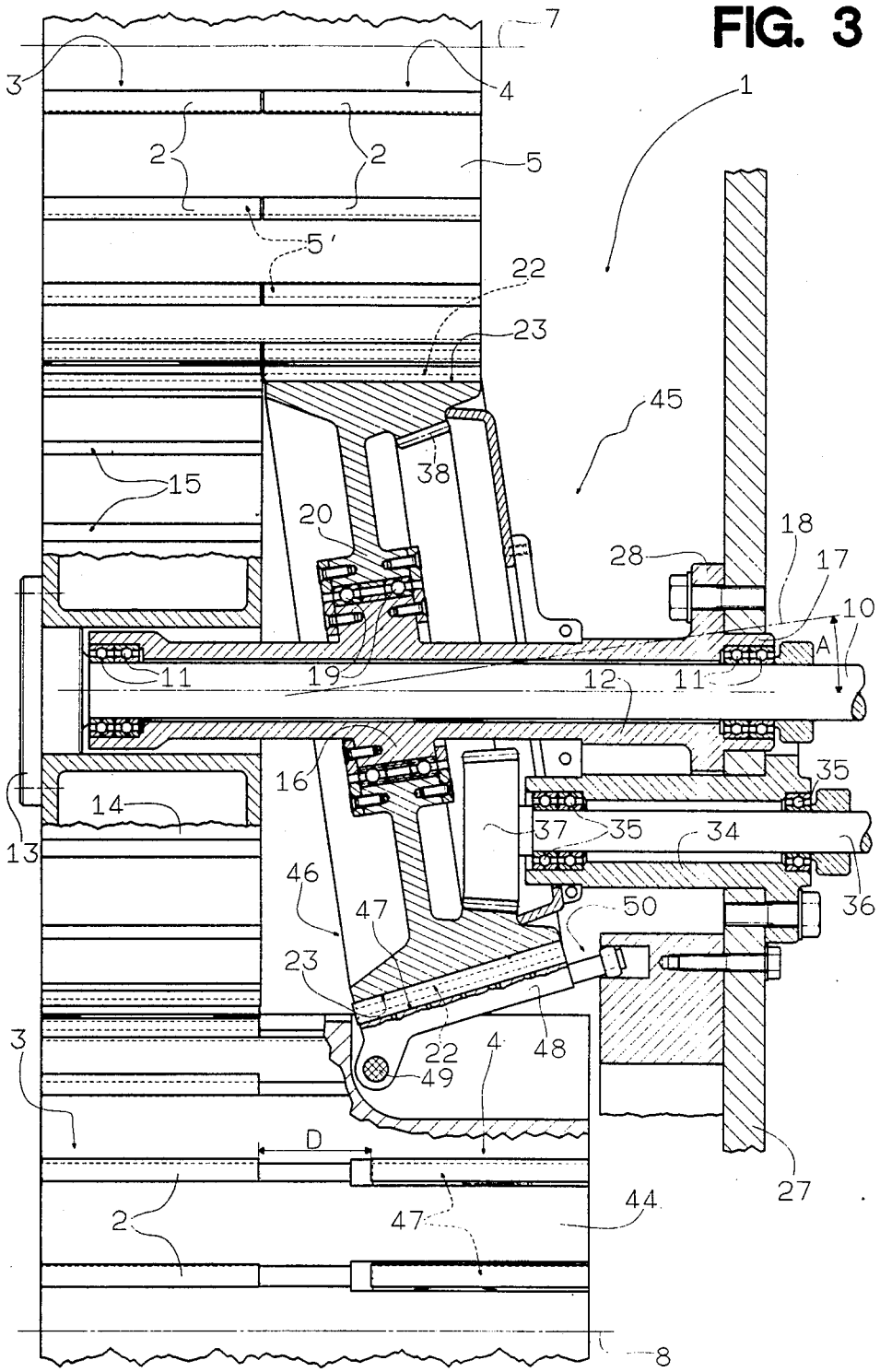

In the FIG. 3 embodiment, performance of the FIG. 1 device is achieved using, in place of output roller 6, an adapter roller 44 connected to a transfer device 45 substantially identical to device 9, the only difference being that, in place of adapter roller 21, it comprises a tapered transfer roller 46 having no swing supports 24 and, as such, performing no adapting function. Roller 46 presents peripheral seats 23 formed directly on truncated-cone outer surface 22, whereas adapter roller 44 presents, next to row 4, seats 47, each formed along a respective support 48 designed to swing about a respective end pin 49 by virtue of an actuating means comprising actuating device 50 carried on adapter roller 44 itself and similar to actuating device 26.

In the FIG. 3 example, surface 22 of roller 46 is tangent to the cylindrical outer surface of roller 5, whereas it forms an angle of twice angle A with the cylindrical surface of adapter roller 44. The said angle is equal to that through which each of supports 48 swings about the axis of respective pin 49.

In a further variation (not shown), roller 5 is replaced by an adapter roller similar to roller 44; roller 44 in the FIG. 3 embodiment is replaced by an output roller similar to roller 6 in FIG. 1; and roller 46 is inclined so that outer surface 22 is tangent to the said output roller.

Figure 2:
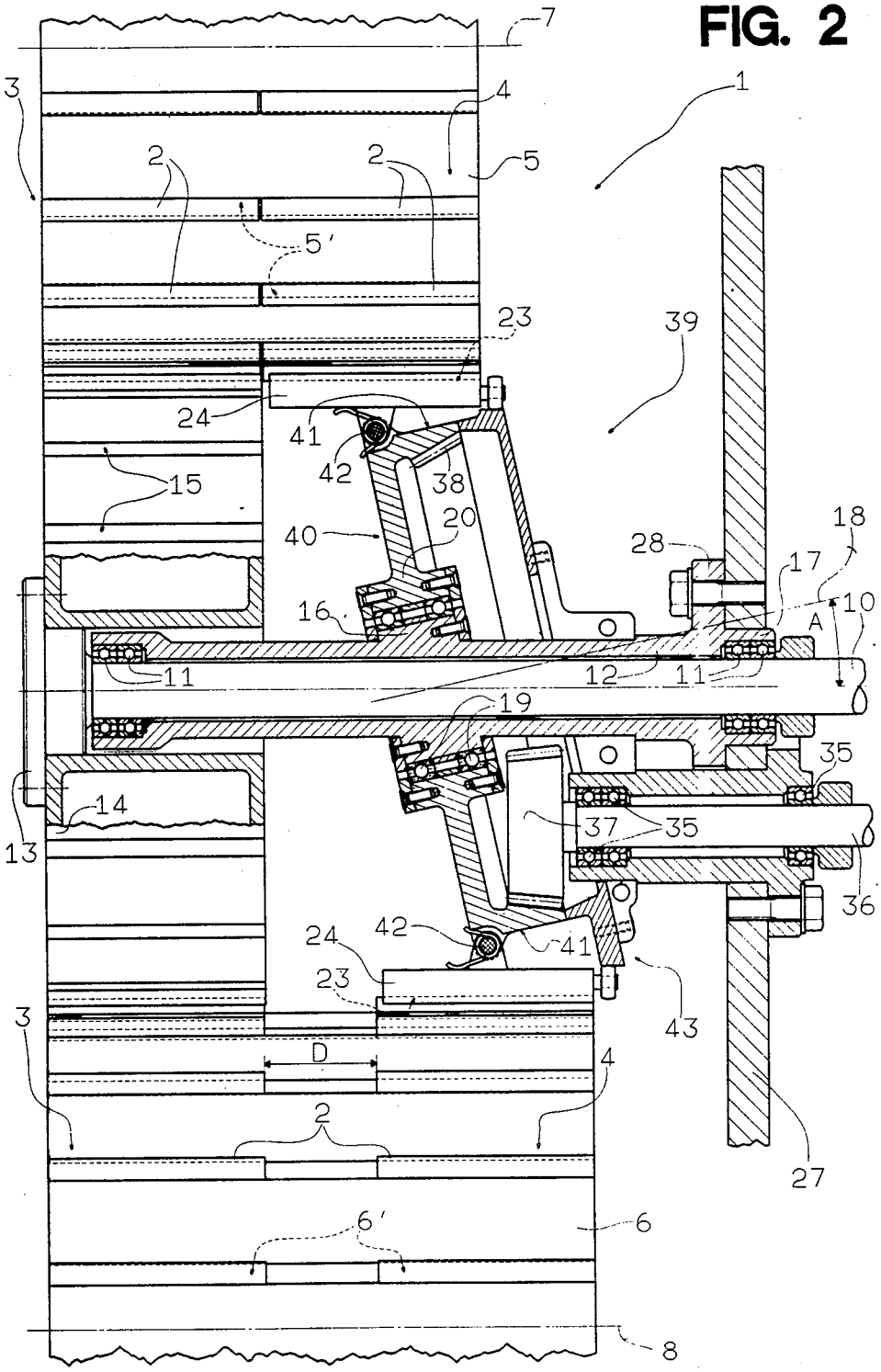
FIGS. 2 and 3 show sections of two alternative embodiments of the FIG. 1 device.

In all the embodiments shown in FIGS. 1, 2 and 3, the same provisions made in connection with row 4 may obviously also be made for row 3, thus enabling axial displacement of cigarettes 2 in both rows 3 and 4.

I claim:

1. A device for axially displacing cigarettes (2) aranged side by side in two substantially parallel rows advancing in a direction (3, 4) substantially perpendicular to the axes of the cigarettes (2); the device (1) comprising an input roller (5) and an output roller (6 or 44) mounted for rotation about the parallel axes of said input and output rollers and designed to feed the cigarettes (2) in the direction along the routes of advancing rows of cigarettes which are substantially perpendicular to the axis of said cigarettes, and transfer means (9 or 39 or 45) for transferring both rows of cigarettes (3, 4) from the input roller (5) to the output roller (6 or 44); said transfer means comprising a transfer roller (21 or 40 or 46) mounted for rotation about an axis (18) inclined with respect to the axes of the input (5) and output (6 or 44) rollers for separating at least one of said rows of cigarettes to a given distance (D) in a direction parallel with said axis of the cigarettes (2); each of said transfer roller, input roller and output roller having peripheral seats (23 or 47) for accommodating said cigarettes, and one of said transfer, input and output rollers being an adapter roller, said adapter roller comprising the respective peripheral seats (23 or 47) for accommodating said cigarettes (2) in said one of said rows of said cigarettes (4), and a plurality of swing supports (24; 48), each swing support having a peripheral cigarette seat, mounted for swinging in a radial plane of the adapter roller and about an axis perpendicular to the rotation axis (18 or 8) of the adapter roller.

2. A device as claimed in claim 1, wherein the adapter roller comprises, for each of said swing supports (24; 48), actuating means (31–33 or 43 or 50) for cyclically displacing the swing support (24; 48) between a first position in which the swing support is parallel with a respective generating line on the adapter roller, and a second position in which the swing support forms, together with the respective generating line, an angle equal to twice a complementary angle (B), said complementary angle being the angle between the inclined axis (18) and the direction of routes of advancing rows of the cigarettes.

3. A device as claimed in claim 1, wherein each of said swing supports (24 or 48) has one end connected to said adapter roller by means of a pivot to swing thereabout in relation to the adapter roller.

4. A device as claimed in claim 1, wherein each of said swing supports (24) has one intermediate portion connected to said adapter roller by means of a pivot to swing thereabout in relation to said adapter roller.

5. A device as claimed in claim 2, wherein the adapter roller is an output roller (44); and the transfer roller consists of a tapered roller (46) tangent to the input roller.

6. A device as claimed in claim 4, wherein the adapter roller is the transfer roller (21 or 40).

7. A device as claimed in claim 1, wherein the transfer roller is a tapered roller (46) which is tangent, along its generating line, to one of the input and output rollers (5; 44).

8. A device as claimed in claim 1, wherein the transfer roller is a substantially cylindrical roller (40).

* * * * *

UNITED STATES PATENT AND TRADEMARK OFFICE

CERTIFICATE OF CORRECTION

PATENT NO. : 4,913,170

DATED : April 3, 1990

INVENTOR(S) : IGINO CONTI

It is certified that error appears in the above-identified patent and that said Letters Patent is hereby corrected as shown below:

ON THE TITLE PAGE: in item [73] change "Turin" to -- Bologna --.

Signed and Sealed this

Eighth Day of October, 1991

*Attest:*

*Attesting Officer*

HARRY F. MANBECK, JR.

*Commissioner of Patents and Trademarks*